US005875566A

United States Patent [19]

Bourdeau et al.

[11] Patent Number: 5,875,566

[45] Date of Patent: Mar. 2, 1999

[54] BOOT AND PROCESS FOR ASSEMBLING A BOOT

[75] Inventors: Joel Bourdeau, Saint-Jorioz; Mariano Sartor, Montobelluna, both of France

[73] Assignee: Salomon S.A., Metz-Tessy, France

[21] Appl. No.: 836,048

[22] PCT Filed: Sep. 13, 1996

[86] PCT No.: PCT/FR96/01420

§ 371 Date: May 13, 1997

§ 102(e) Date: May 13, 1997

[87] PCT Pub. No.: WO97/09893

PCT Pub. Date: Mar. 20, 1997

[30] Foreign Application Priority Data

Sep. 14, 1995 [FR] France ..... 95.11009

[51] Int. Cl.[6] ..... A43B 13/28; A43B 15/00; A43D 9/00

[52] U.S. Cl. ..... 36/12; 36/69; 36/22 A; 36/78; 36/45; 36/117.1; 12/142 T

[58] Field of Search ..... 12/142 RS, 142 T; 36/12, 14, 17 PW, 17 A, 69, 22 A, 78, 117.1, 117.2, 4, 45

[56] References Cited

U.S. PATENT DOCUMENTS

| | | | |
|---|---|---|---|
| 1,185,119 | 5/1916 | Marshall | 36/4 |
| 1,853,034 | 4/1932 | Bradley | 36/14 |
| 2,306,306 | 12/1942 | Ferrettie | 36/4 |
| 3,414,989 | 12/1968 | Odermatt | 3/14 |
| 3,597,862 | 8/1971 | Vogel | 36/117.1 |
| 4,707,874 | 11/1987 | Champagne | 36/4 |
| 5,435,080 | 7/1995 | Meiselman | 36/45 |

FOREIGN PATENT DOCUMENTS

| | | |
|---|---|---|
| 2643796 | 9/1990 | France . |
| 1685348 | 6/1971 | Germany . |

*Primary Examiner*—M. D. Patterson
*Attorney, Agent, or Firm*—Greenblum & Bernstein, P.L.C.

[57] ABSTRACT

A boot and a process for assembling the boot, the boot including a flexible upper and a rigid sole. The process includes the assembling of the flexible upper and the rigid sole with the use of an intermediate portion, the intermediate portion obtained by shaping a flexible material. At least two steps of the process includes at least the following: covering a portion of the sole with the intermediate portion to form a junction surface and applying a pressure on the outside of the boot to tighten the intermediate portion against the sole at the level of the junction surface.

20 Claims, 2 Drawing Sheets

BOOT AND PROCESS FOR ASSEMBLING A BOOT

BACKGROUND OF THE INVENTION

1. Field of the Invention

The invention relates to the field of boot assembling, and relates more particularly to boots that comprise a rigid sole and a flexible upper.

2. Description of Background and Relevant Information

These boots are generally used in gliding, walking, or rolling sports, such as snowboarding, skiing, hill-walking, roller skating, biking or the like.

Indeed, these sports require that the user be able to take reliable supports with the foot, while maintaining a minimum comfort and mobility of the leg.

A rigid sole makes it possible, for example, to retain a boot on a gliding apparatus such as a snowboard or a ski, or to reduce the fatigue of the user's foot by avoiding contraction of the muscles of the arch of the foot, especially in the case of point/punctual support of the sole on the ground.

A flexible upper enables the user to move the legs to manage his balance or operate the gliding apparatus.

However, regardless of the mode or field of utilization of this type of boot, the manufacture requires an affixation of the sole and of the upper. The affixation is done conventionally by gluing or by injection, because there is currently no machine that is capable of sewing a flexible upper on a rigid sole.

A classic example is that of boots having a flexible upper. The upper is mounted on a rigid and glued form. The sole is then positioned on the upper, and a pressure is applied between the sole and the form so as to perform the adhesion. The flexibility of the sole enables the latter to properly press on the upper mounted on the form. The quality of the adhesion essentially depends on the pressure applied during this operation.

The problem is more complex in the case of boots with a rigid sole. It is impossible to use the traditional gluing technique because the sole cannot deform sufficiently to press on the upper, regardless of the pressure used.

The solution then consists of using an injection technique explained hereinafter.

An upper is mounted on a form to constitute an assembly positioned within a mold that has the dimensions of the boot to manufacture. A volume that corresponds substantially to the sole of the boot remains between the walls of the mold and the assembly. This volume is filled by a plastic material hot injected at high pressure, generally comprised between 100 and 200 bars. After cooling, the plastic material has the aspect of a rigid sole affixed to the flexible upper: the boot is completed.

However, this injection technique has numerous disadvantages.

Certain disadvantages come from the fact that the volume to be filled by the plastic material to make the sole is not constant; indeed, the manufacturing tolerances for a flexible upper are substantial because of the stresses related to the construction, and a flexible upper is capable of being compressed under the effect of the injection pressure. As a result, the affixation of the rigid sole to the flexible upper is imperfect and/or irregular. It also follows that the volume available for the user's foot is reduced randomly, which has the effect of creating discomforts and traumatisms during use.

It also follows that the physical properties of the sole are often considerably altered when the pressure drops too much during injection. Indeed, the pressure is maintained at a sufficient level only in the case where the volume to be filled is constant, by means of the press technology.

Other disadvantages of the injection technique are related to scaling factors. First, a mold is needed for each boot size, whose manufacture is often time-consuming and costly, and whose amortization imposes mass production.

Furthermore, any modification of a boot leads to an equally costly modification of the mold.

The pressurized injection of the plastic requires adequate equipment.

The implementation of such a process is complex and requires a sophisticated equipment, as well as qualified personnel.

SUMMARY OF THE INVENTION

Therefore, such an injection technique by duplicate molding is not really satisfactory.

To remedy these disadvantages, the invention proposes a process for assembling a boot including a flexible upper and a rigid sole. The boot assembly process according to the invention is characterized in that it consists of assembling the flexible upper and the rigid sole to one another through an intermediate portion obtained by shaping a flexible material, the intermediate portion being affixed to the upper by a linkage means such as a seam or an adhesion, on the one hand, and to the sole by an adhesive means, the adhesive means being arranged on a junction surface for the intermediate portion and the sole.

The boot assembly process is also characterized in that at least two steps of the process consist of:

covering a portion of the sole with the intermediate portion to form the junction surface, applying a pressure on the outside of the boot to tighten the intermediate portion against the sole at the level of the junction surface.

This process makes it possible to utilize manufacturing means that are simple, easy and quick to implement, which has the advantage of minimizing the production costs.

The molded intermediate portion has a regular geometry which advantageously enables the obtention of clean, watertight and mechanically resistant gluing.

Furthermore, the process according to the invention is characterized in that a stop means positions the intermediate element with respect to the sole. The upper and the sole are therefore assembled with precision, and this being for each boot made. As a result, a series of boots advantageously have a very low rejection rate.

BRIEF DESCRIPTION OF THE INVENTION

Others characteristics and advantages of the invention will be better understood along the description that follows, with reference to the annexed drawing illustrating, by way of a non-limiting example, how the process can be embodied, and in which.

DETAILED DESCRIPTION OF THE INVENTION

Figure 1:
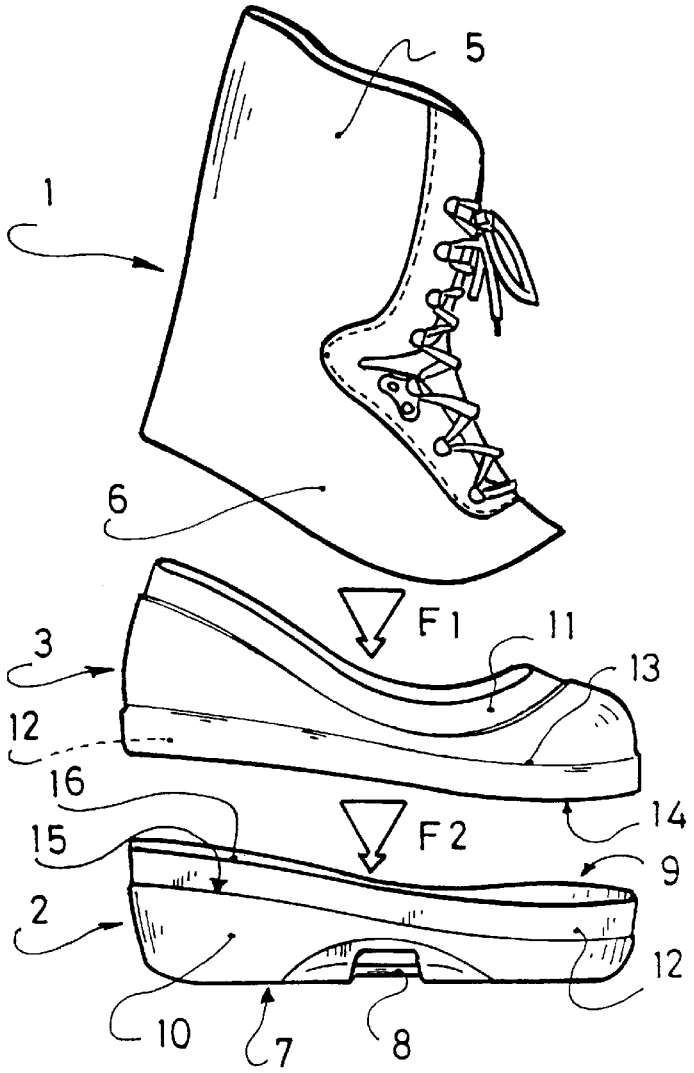
FIG. 1 shows the assembly of an upper and of a sole through an intermediate portion according to the process of the invention.
Figure 2:
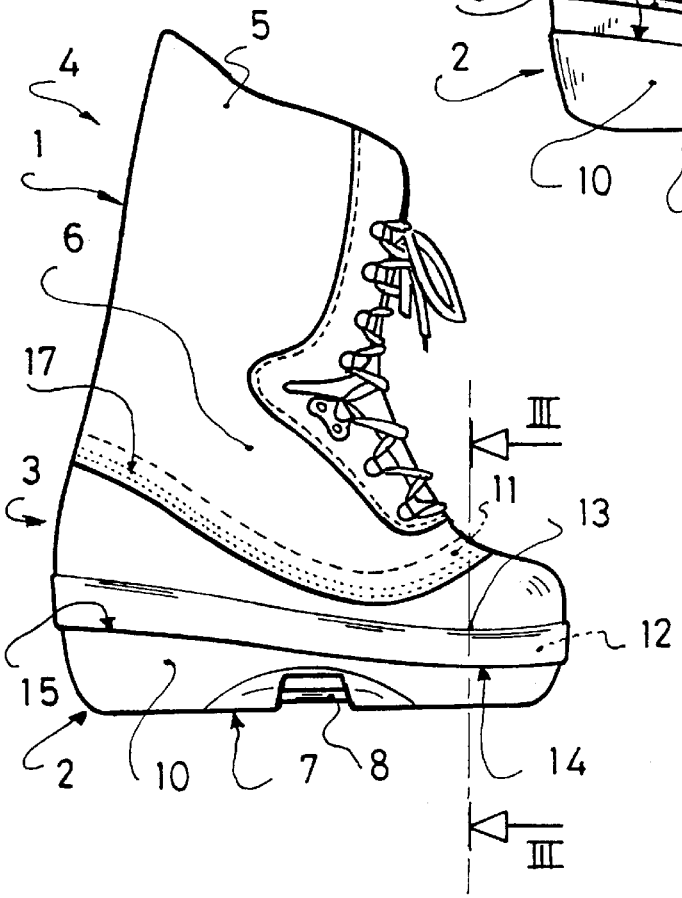
FIG. 2 shows a boot obtained after the assembly.

FIGS. 1 and 2 correspond to initial and final steps, respectively, of the process of the invention.

FIG. 1 schematically shows an assembly of an upper 1 and of a sole 2 through an intermediate portion 3 to obtain a boot 4 according to the process that will be explained subsequently.

The upper 1 according to the example is a conventional high upper including an upper end 5 that extends over the lower part of the leg, and a lower end 6 that surrounds the user's foot. It could also be a so-called low upper including a lower end 6 only.

The upper 1 is made, for example, by means of layers of fabrics and/or leather according to a known cutting and assembling operation. The structure and materials used provide the upper 1 with a certain flexibility.

On the contrary, the sole 2 is, for example, a piece made from one or more rigid materials, such as certain reinforced or non-reinforced molded plastics. The mechanical properties and the size of the materials prevent the sole 2 from being deformed by the action of the forces exerted during practice of a sport or walking.

The sole 2 includes a lower surface 7 adapted to enter into contact with the ground or with a gliding or rolling apparatus. It can be retained on the apparatus by a hooking means or attachment device shown here in the form of an insert 8. The sole 2 is extended at its periphery and on the side of its upper surface 9, or upper end, by a rigid belt 10, or upstanding peripheral wall.

The intermediate portion 3 is a piece obtained by shaping a flexible material such as certain plastics or rubbers, through processes such as injection molding or the like. The intermediate piece 3 has the appearance of a truncated upper.

The process assembly for the boot 4 according to the invention includes a series of steps some of which are known and are not described herein.

After manufacturing the upper 1, the sole 2 and the intermediate portion 3 in any order, one step of the process according to the invention consists of affixing the upper 1 to the intermediate portion 3, along arrow F1, using a linkage means such as a stitched seam. To this end, the intermediate portion 3 includes a zone 11 for joining the intermediate portion 3 and the upper 1. The thickness of the junction zone 11 is sufficiently reduced to allow for a linkage by sewing of the upper 1 with the intermediate portion 3, the linkage including a partial superimposition of the upper 1 and of the intermediate portion 3 at an engagement surface on an external side of the junction zone 11. The assembly then formed by the intermediate portion 3 and the upper 1 is affixed to the sole 2, in the direction of arrow F2, as will be explained hereinafter.

The intermediate portion 3 is provided to cover a portion of the sole 2 to form a junction or zone surface 12 common to the intermediate portion 3 and to the sole 2. As can be seen in FIG. 1, the junction surface 12 of the intermediate portion is an internal surface of the lower end of the intermediate portion, whereas the junction surface 12 of the sole is an external surface of the upper end of the sole. The junction surface 12 is visually defined by the distance separating an edge 13 and a lower edge 14 on the intermediate portion 3, and by the distance separating an edge 15 from an upper edge 16 on the sole 2.

The junction surface 12 is therefore a peripheral band of the boot 4.

An adhesive means, used for example in the form of a glue, is applied on the intermediate portion 3 and/or on the sole 2 at the level of the junction surface 12 before the intermediate portion 3 is in contact with the portion of the sole 2.

Preferably, the glue is arranged over the entire junction surface 12, so as to guarantee a good mechanical strength and a proper sealing for the boot 4 after assembly.

The intermediate portion 3 is brought on the sole 2 such that at the level of the junction surface 12, the intermediate portion 3 is outside of the sole 2.

Preferably, the edge 15 of the sole 2 located on one side of the junction surface 12 plays the role of a stop or abutment provided to position the intermediate piece 3 with respect to the sole 2.

It then becomes easy to assemble the intermediate portion 3 and the sole 2. These elements are placed in a box and, in a known manner, a peripheral pressure is exerted by a bladder, not shown, to tighten the intermediate portion 3 against the sole 2 at the level of the junction surface 12.

The result is an assembled boot as shown in FIG. 2.

A stitched seam 17 ensures the linkage between the upper 1 and the intermediate portion 3 as previously mentioned.

The junction surface 12 holds the intermediate portion 3 with respect to the sole 2; the quality of the holding of these elements 2, 3, by means of the glue is equal to that obtained, for example, on traditional boots having a flexible sole. Indeed, the rigidity of the sole 2 has provided the belt 10 with a sufficient mechanical strength not to bend under the action of the bladder. It follows that the glue has been subjected to high pressure, which is ensures quality and reliability.

Figure 3:
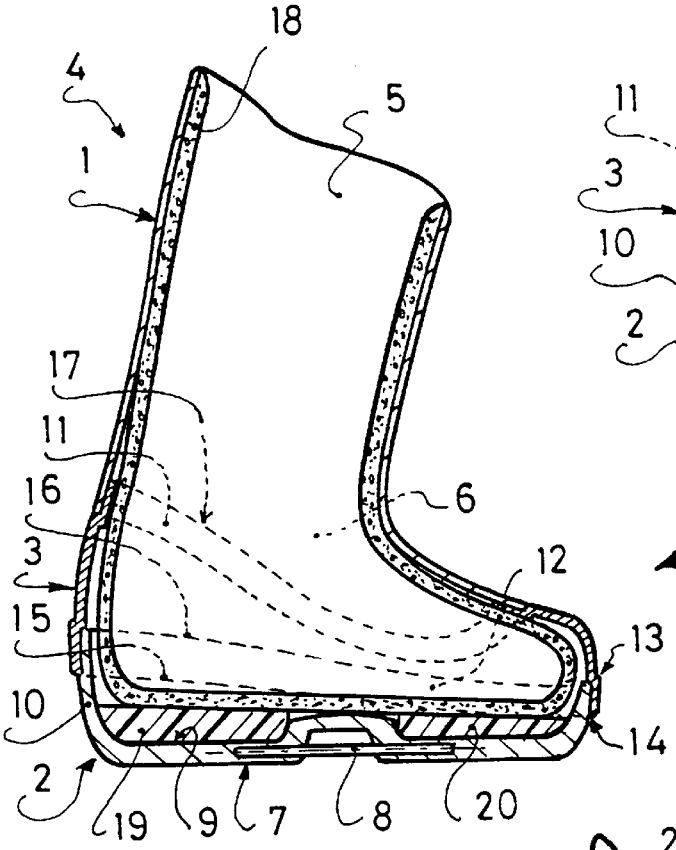
FIG. 3 is a cross section along III—III of FIG. 2.
Figure 4:
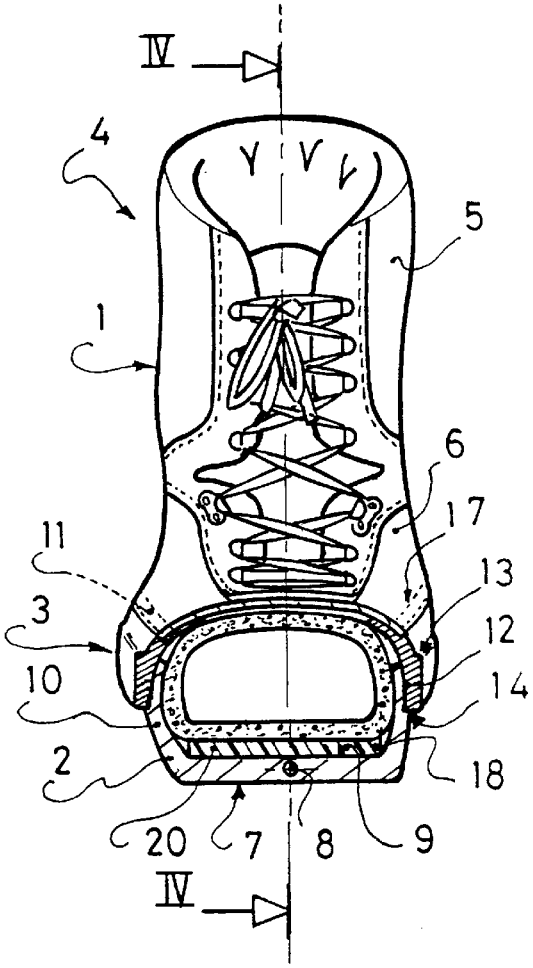
FIG. 4 is a cross section along IV—IV of FIG. 3.

The cross-sections of FIGS. 3 and 4 show better the structure and the linkages of the parts of the boot 4.

A liner 18 and shock absorbers 19, 20 are attached in the boot 4 in a conventional manner.

The linkages of the various parts are distributed over the entire circumference of the boot 4. The embodiment is easy and inexpensive to implement. It allows for a great flexibility of adaptation in the production, since the same bladder can glue a boot for the right foot or left foot, regardless of its size.

The process can be adapted to all types of glues; in particular, cold gluing and hot gluing are possible.

Figure 5:
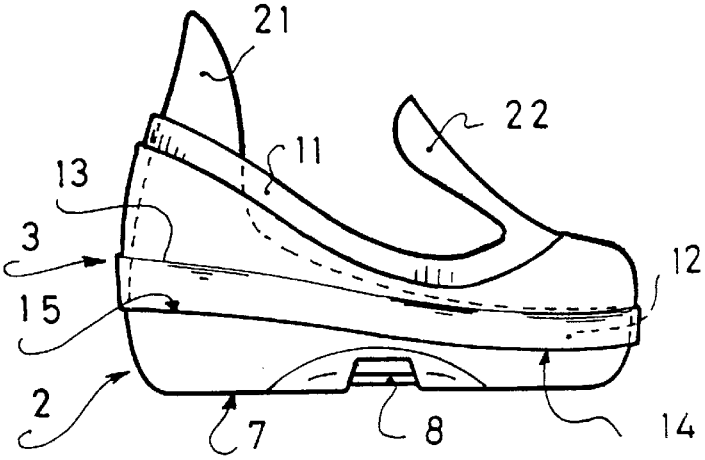
FIG. 5 shows a particular case of embodiment of a sole and of an intermediate portion.

According to a variation of structure shown in FIG. 5, the sole 2 includes a rear tongue 21 which rises above the junction zone 12 on the side of the heel of the boot 4. Another tongue 22 i.e., a forward tongue, is affixed to the intermediate portion 3 and is located at the level of the lower end 6 of the upper 1.

The tongues 21, 22, facilitate transmissions of forces by the foot or the leg, and improve the perception of sensorial information during walking or practice of a sport. The tongues 21, 22, also facilitate the manufacture and help to manipulate and position the constituent parts of the boot 4.

Of course, the invention is not limited to the embodiment thus described, and includes all the technical equivalents that fall within the scope of the claims that follow.

In particular, one can provide to apply the pressure by means of a set of thrustors to glue the intermediate portion 3 on the sole 2.

The junction surface 12 can vary in its form and location.

The intermediate portion 3 can be made from one or more sheets of materials cut and shaped on matrix, using a heating means or not.

The means for stopping the intermediate portion 3 on the sole 2 can be obtained otherwise than through the edge 15.

We claim:

1. A boot comprising:

a flexible upper including at least a lower end extending over a user's foot;

a rigid sole having a junction zone extending around said sole;

a flexible intermediate portion having a lower end, said lower end of said intermediate portion having a junction zone, said junction zone of said flexible intermediate portion being common to said junction zone of said sole, said common junction zone being upwardly extending;

said flexible intermediate portion being affixed to said flexible upper;

said flexible intermediate portion being affixed to said rigid sole by means of an adhesive at said common junction zone.

2. A boot according to claim 1, wherein:

said flexible intermediate portion is affixed to said flexible upper by means of a stitched seam.

3. A boot according to claim 1, wherein:

said flexible intermediate portion is affixed to said flexible upper by means of an adhesive.

4. A boot according to claim 1, wherein:

said flexible intermediate portion is affixed to said rigid sole exclusively by means of an adhesive at said common junction zone.

5. A boot according to claim 1, wherein:

said junction zone of said sole is at an upper end portion of said sole; and said lower end of said intermediate portion overlaps said upper end portion of said sole, said upper end portion of said sole including an edge extending around said sole, said lower end of said intermediate portion abutting said edge.

6. A boot according to claim 1, wherein:

said junction zone of said sole is at an upper end of said sole;

said junction zone of said intermediate portion is an internal surface of said lower end of said intermediate portion; and said junction zone of said sole is an external surface of said upper end of said sole.

7. A boot according to claim 6, wherein:

said flexible intermediate portion has a preformed shape, said internal surface of said lower end of said intermediate portion being preshaped to correspond in shape to said external surface of said upper end of said sole.

8. A boot according to claim 6, wherein:

said flexible intermediate portion has a preformed molded shape, said internal surface of said lower end of said intermediate portion being preshaped to correspond in shape to said external surface of said upper end of said sole.

9. A boot according to claim 1, wherein:

said flexible upper is a high upper including an upper end surrounding a lower part of the user's leg.

10. A boot according to claim 1, wherein:

said flexible upper is a low upper including only said lower end extending over the user's foot.

11. A boot according to claim 1, wherein:

said rigid sole further comprises a rear tongue extending upwardly beyond said common junction zone at a rear end of the boot; and said flexible intermediate portion further comprises a forward tongue located at a level of said lower end of said flexible upper.

12. A boot according to claim 1, wherein:

said junction zone of said intermediate portion has a thickness reduced with respect to the remainder of said intermediate portion.

13. A boot according to claim 1, wherein:

said sole further includes an upstanding peripheral wall, said junction zone of said sole comprises a surface of said upstanding peripheral wall.

14. A boot according to claim 13, wherein:

said junction zone of said sole has a thickness reduced with respect to the remainder of said upstanding peripheral wall of said sole.

15. A boot according to claim 1, wherein:

said junction zone of said intermediate portion has a thickness reduced with respect to the remainder of said intermediate portion;

said sole further includes an upstanding peripheral wall, said junction zone of said sole comprises a surface of said upstanding peripheral wall; and said junction zone of said sole has a thickness reduced with respect to the remainder of said upstanding peripheral wall of said sole.

16. A process for assembling a boot, whereby the boot includes a flexible upper formed by shaping a flexible material, a rigid sole, and a flexible intermediate portion, the flexible upper including at least a lower end extending over a user's foot, the rigid sole having an upwardly extending peripheral junction zone, and the flexible intermediate portion having a lower end having an upwardly extending junction zone, said process comprising:

affixing said flexible upper to said flexible intermediate portion;

affixing said flexible intermediate portion to said sole by affixing said junction zone of said flexible intermediate portion to said junction zone of said sole by means of an adhesive, whereby said junction zone of said flexible intermediate portion is common with said junction zone of said sole.

17. A process according to claim 16, wherein:

said affixing said flexible intermediate portion to said sole comprises overlapping said junction zone of said flexible intermediate portion over said junction zone of said sole; and applying a pressure on the outside of the boot to secure said intermediate portion against said sole at said junction zones of said intermediate portion and said sole.

18. A process according to claim 16, wherein:

said adhesive is a glue.

19. A process according to claim 18, wherein:

said glue is applied over the entirety of said common junction zone of said intermediate portion and said sole.

20. A process according to claim 16, wherein:

an edge extends around said sole at a lower end of said junction zone of said sole; and said affixing said flexible intermediate portion to said sole comprises overlapping said flexible intermediate portion over said sole and abutting said lower end of said intermediate portion against said edge of said sole.

* * * * *